US005424027A

United States Patent [19]

Eylon

[11] Patent Number: 5,424,027

[45] Date of Patent: Jun. 13, 1995

[54] METHOD TO PRODUCE HOT-WORKED GAMMA TITANIUM ALUMINIDE ARTICLES

[75] Inventor: Daniel Eylon, Dayton, Ohio

[73] Assignee: The United States of America as represented by the Secretary of the Air Force, Washington, D.C.

[21] Appl. No.: 161,620

[22] Filed: Dec. 6, 1993

[51] Int. Cl.[6] ..... B22F 3/00; B22F 7/00

[52] U.S. Cl. ..... 419/49; 419/28; 419/29; 419/38; 419/55

[58] Field of Search ..... 148/671; 419/28, 29, 419/38, 49

[56] References Cited

U.S. PATENT DOCUMENTS

| | | | |
|---|---|---|---|
| 5,098,484 | 3/1992 | Eylon et al. | 148/11.5 F |
| 5,098,650 | 3/1992 | Eylon et al. | 419/48 |
| 5,190,603 | 3/1993 | Nazmy et al. | 148/671 |
| 5,226,985 | 7/1993 | Kim et al. | 148/671 |
| 5,296,056 | 3/1994 | Jain et al. | 148/421 |

*Primary Examiner*—Donald P. Walsh

*Assistant Examiner*—John N. Greaves

*Attorney, Agent, or Firm*—Charles E. Bricker; Thomas L. Kundert

[57] ABSTRACT

A method for producing hot worked gamma titanium aluminide alloy articles which comprises the steps of:

(a) providing a prealloyed gamma titanium aluminide alloy powder;

(b) filling a suitable die or mold with the powder;

(c) hot isostatic press (HIP) consolidating the powder in the filled mold at a pressure of 30 Ksi or greater and at a temperature below the alpha−two+-gamma eutectoid temperature of the alloy to produce a preform;

(d) hot working the preform at a temperature at or below the alpha−two+gamma eutectoid temperature of the alloy; and (e) optionally, heat treating the hot worked article.

By hot working the preform at or below the alpha−two+gamma eutectoid temperature, the fine, uniform, isotropic microstructure of the preform is maintained, allowing a large metal flow and good shape definition with no edge cracking.

6 Claims, 1 Drawing Sheet

METHOD TO PRODUCE HOT-WORKED GAMMA TITANIUM ALUMINIDE ARTICLES

RIGHTS OF THE GOVERNMENT

The invention described herein may be manufactured and used by or for the Government of the United States for all governmental purposes without the payment of any royalty.

BACKGROUND OF THE INVENTION

This invention relates to the forging of gamma titanium aluminide alloys.

Titanium alloy parts are ideally suited for advanced aerospace systems because of their excellent general corrosion resistance and their unique high specific strength (strength-to-density ratio) at room temperature and at moderately elevated temperatures. Despite these attractive features, the use of titanium alloys in engines and airframes is often limited by cost due, at least in part, to the difficulty associated with forging and machining titanium.

Recent developments in advanced hypersonic aircraft and propulsion systems require high temperature, low density materials which allow higher strength to weight ratio performance at higher temperatures. As a result, titanium aluminide alloys are now being targeted for many such applications. Titanium aluminide alloys based on the ordered gamma TiAl phase are currently considered to be one of the most promising group of alloys for this purpose. These alloys are lightweight, yet resistant to oxidation and deformation at temperatures as high as 1800° F. (1000° C.). However, the TiAl ordered phase is very brittle at lower temperatures and has low resistance to cracking under cyclic thermal conditions. For the same reasons that these alloys are resistant to high temperature deformation, they are also very difficult to hot work, as by forging, and as a result, it is difficult to manufacture complex shape high quality components.

Accordingly, it is an object of the present invention to provide an improved process for hot working gamma titanium aluminide alloys.

Other objects, aspects and advantages of the present invention will be apparent to those skilled in the art after reading the detailed description of the invention as well as the appended claims.

SUMMARY OF THE INVENTION

In accordance with the present invention there is provided a method for producing hot worked gamma titanium aluminide alloy articles which comprises the steps of:

(a) providing a prealloyed gamma titanium aluminide alloy powder;

(b) filling a suitable die or mold with the powder;

(c) hot isostatic press (HIP) consolidating the powder in the filled mold at a pressure of 30 Ksi or greater and at a temperature below the alpha−two+-gamma eutectoid temperature of the alloy to produce a preform;

(d) hot working the preform at a temperature at or below the alpha−two+gamma eutectoid temperature of the alloy; and (e) optionally, heat treating the hot worked article.

DETAILED DESCRIPTION OF THE INVENTION

The titanium-aluminum alloys suitable for use in the present invention are the gamma alloys containing about 45–55 atomic percent aluminum and about 55–45 atomic percent titanium, and, optionally, modified with about 0.1–5 atomic percent of at least one beta stabilizer selected from the group consisting of Nb, Mo, Mn, Cr, W and V. Examples of titanium-aluminum alloys suitable for use in the present invention include Ti-50Al, Ti-48Al-1Nb, Ti-48Al-2Nb-2Cr, Ti-48Al-1Nb-1V and Ti-48Al-3Nb-2Cr-1Mn (expressed in atomic percent).

Figure 1:
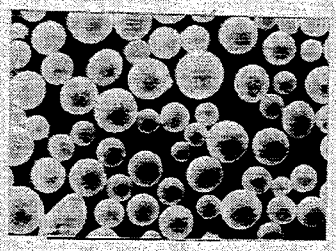
FIG. 1 is a 25× photomicrograph illustrating rapidly solidified prealloyed gamma TiAl alloy powder particles.

For production of high quality hot working preforms according to the invention, spherical, prealloyed powder free of detrimental foreign particles is desired. In contrast to flake or angular particles, spherical powder (FIG. 1) flows readily, with minimal bridging tendency, and packs to a consistent tap density (about 65%).

Figure 2:
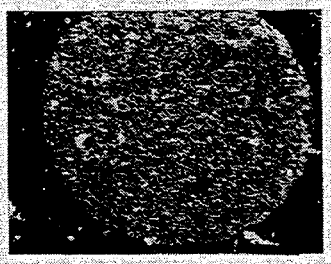
FIG. 2 is a 200× photomicrograph illustrating the ultrafine microstructure of rapidly solidified prealloyed gamma TiAl alloy powder particles.

A variety of techniques may be employed to make the titanium alloy powder, including the rotating electrode process (REP) and variants thereof such as melting by plasma arc (PREP) or laser (LREP) or electron beam, electron beam rotating disc (EBRD), powder under vacuum (PSV), gas atomization (GA) and the like. These techniques typically exhibit cooling rates of about 100° to 100,000° C./sec. The powder typically has a diameter of about 25 to 600 microns and, as a result of the high cooling rate, has an ultrafine grain structure (FIG. 2).

Production of the preform may be accomplished using a metal can, ceramic mold or fluid die technique. In the metal can technique, a metal can is shaped to the desired configuration by state-of-the-art sheet-metal methods, e.g. brake bending, press forming, spinning, superplastic forming, etc. The most satisfactory container appears to be carbon steel, which reacts minimally with the titanium, forming titanium carbide which then inhibits further reaction. Fairly complex shapes have been produced by this technique.

The ceramic mold shape making process relies basically on the technology developed by the investment casting industry, in that molds are prepared by the lost-wax process. In this process, wax patterns are prepared as shapes intentionally larger than the final configuration. This is necessary since in powder metallurgy a large volume difference occurs in going from the wax pattern (which subsequently becomes the mold) and the consolidated compact. Knowing the desired configuration of the compacted shape, allowances can be made using the packing density of the powder to define the required wax-pattern shape.

The fluid die or rapid omnidirectional consolidation (ROC) process is an outgrowth of work on glass containers. In the current process, dies are machined or cast from a range of carbon steels or made from ceramic materials. The dies are of sufficient mass and dimensions to behave as a viscous liquid under pressure at temperature when contained in an outer, more rigid pot die, if necessary. The fluid dies are typically made in two halves, with inserts where necessary to simplify manufacture. The two halves are then joined together to form a hermetic seal. Powder loading, evacuation and consolidation then follow. The fluid die process is claimed to combine the ruggedness and fabricability of metal with the flow characteristics of glass to generate a replicating container capable of producing extremely complex shapes.

In the metal can and ceramic mold processes, the powder-filled mold is supported in a secondary pressing medium contained in a collapsible vessel, e.g., a welded metal can. Following evacuation and elevated-temperature outgassing, the vessel is sealed, then placed in an autoclave or other apparatus capable of isostatically compressing the vessel.

Consolidation of the titanium alloy powder is accomplished by applying a pressure of at least 30 ksi, preferably at least about 35 ksi, at a temperature below the alpha−two+gamma eutectoid temperature of the alloy (about 1100° C.) for about 1 to 48 hours in processes such as HIP, or about 0.25 sec. up to about 300 sec. in processes such as ROC and extrusion. It is presently preferred that the consolidation temperature be about 70 to 95 percent of the eutectoid temperature (in degrees C.). It will be recognized by those skilled in the art that the practical maximum applied pressure is limited by the apparatus employed.

Figure 3:
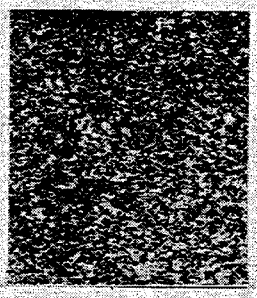
FIG. 3 is a 100× photomicrograph illustrating the ultrafine and isotropic microstructure of a TiAl alloy preform produced in accordance with the invention.
Figure 4:
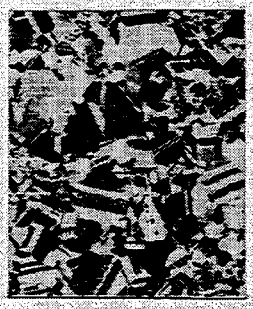
FIG. 4 is a 100× photomicrograph illustrating the microstructure of a TiAl alloy preform produced by ordinary methods of ingot metallurgy.

Following consolidation, the preform is recovered using techniques known in the art. The resulting preform is fully dense and has a very fine, uniform and isotropic microstructure (FIG. 3). In contrast, the coarse microstructure of a preform prepared by ingot metallurgy is shown in FIG. 4.

Figure 5:
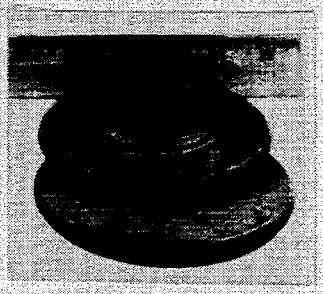
FIG. 5 is a photograph illustrating the result of forging a TiAl alloy preform in accordance with the invention.
Figure 6:
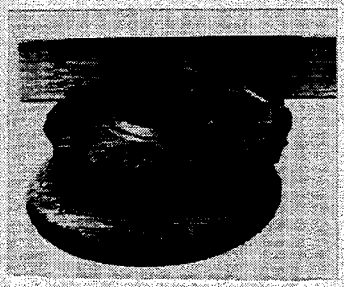
FIG. 6 is a photograph illustrating the result of forging a cast TiAl alloy billet.

The preform is then hot formed. The equipment used to hot form the preform is the same equipment used for other metals, namely, hydraulic presses, hammers, extruders, mechanical and screw presses, rolls, and the various modifications of high energy equipment. The method of hot forming can be cold die, hot die, isothermal, open-die, closed-die or the like. The preform may be preheated to the hot forming temperature. Regardless of the equipment or method used, it is important that the temperature of the piece being hot worked be maintained, during preheating and hot working, at or below the alpha−two+gamma eutectoid temperature. For example, the preform can be isothermally forged at about 1100° C. with a short dwell time at the bottom of the stroke. By forging the preform at or below the alpha−two+gamma eutectoid temperature, the fine, uniform, isotropic microstructure of the preform is maintained, allowing a large metal flow and good shape definition with no edge cracking (FIG. 5). In contrast, the result of forging a cast billet is shown in FIG. 6. This forging exhibits considerable edge cracking.

After hot working, the resulting article may be heat treated, in whole or in selected regions, to alter the microstructure thereof to improve creep resistance or fracture toughness or other desired mechanical properties. The heat treatment may simply be a stabilization treatment or a two-step heat treatment, first to solutionize and/or recrystallize the hot worked material in either the alpha or alpha+gamma phase fields, and second, to stabilize the microstructure and phase compositions by heat treating at temperatures in the alpha−two+gamma phase field. The solution treatment step controls the lamellar/gamma grain volume ratio as well as the size of the constituents.

Typical heat treatment conditions for the alloy Ti-48Al-2Nb-2Cr (atomic %) are, for example: 1290° C. for 3 hours will produce a fine, all-equiaxed gamma structure; 1350° C. for 1 hour will produce coarse equiaxed gamma structure with 20% lamellar structure; and 1400° C. for 30 minutes will produce an all coarse lamellar structure.

As noted above, the post-hot working heat treatment is optional. The hot worked articles may be used in the as-worked condition and will possess many good mechanical properties, such as high room temperature tensile strength and high room temperature tensile elongation.

Various modifications may be made to the invention as described without departing from the spirit of the invention or the scope of the appended claims.

I claim:

1. A method for producing hot worked gamma titanium aluminide alloy articles which comprises the steps of:

(a) providing a prealloyed gamma titanium aluminide alloy powder;

(b) filling a suitable die or mold with the powder;

(c) hot isostatic press (HIP) consolidating the powder in the filled mold at a pressure of 30 Ksi or greater and at a temperature below the alpha−two+-gamma eutectoid temperature of the alloy to produce a preform; and (d) hot working the preform at a temperature at or below the alpha−two+gamma eutectoid temperature of the alloy.

2. The method of claim 1 further comprising the step of heat treating the hot worked article.

3. The method of claim 1 wherein the preform is hot worked by isothermal forging at about 1100° C.

4. The method of claim 2 wherein said heat treating step consists of heating the article at 1290° C. for 3 hours.

5. The method of claim 2 wherein said heat treating step consists of heating the article at 1350° C. for 1 hour.

6. The method of claim 2 wherein said heat treating step consists of heating the article at 1400° C. for 30 minutes.

* * * * *